United States Patent [19]

Cellier et al.

[11] 4,059,399

[45] Nov. 22, 1977

[54] COOLED TUNNEL-FURNACE WITH GROUND EFFECT

[75] Inventors: Michel Jean Jacques Cellier, Hendaye; Jean-Claude Guitton, Tarnos; Jean-Claude Scholle, Arcangues; Stephane Georges Jean-Marie Viannay, Plaisir, all of France

[73] Assignee: Bertin & Cie, Plaisir, France

[21] Appl. No.: 661,985

[22] Filed: Feb. 27, 1976

[30] Foreign Application Priority Data

Mar. 4, 1975 France ..... 75.06742

[51] Int. Cl.[2] ..... F27B 9/00

[52] U.S. Cl. ..... 432/121; 432/145

[58] Field of Search ..... 432/121, 144, 145, 83

[56] References Cited

U.S. PATENT DOCUMENTS

| | | | |
|---|---|---|---|
| 1,657,959 | 1/1928 | Crosland | 432/121 |
| 2,201,988 | 5/1940 | Cope | 432/83 |
| 3,325,157 | 6/1967 | Cook | 432/145 |
| 3,473,792 | 10/1963 | Arnold et al. | 432/145 |
| 3,524,498 | 8/1970 | Galer | 432/83 |
| 3,830,624 | 8/1974 | Sperring et al. | 432/145 |
| 3,850,572 | 11/1974 | Andrus | 432/144 |
| 3,925,005 | 12/1975 | Everhardt et al. | 432/145 |
| 3,942,943 | 3/1976 | Andrus | 432/121 |

*Primary Examiner*—John J. Camby

*Attorney, Agent, or Firm*—A. W. Breiner

[57] ABSTRACT

A tunnel-furnace is cooled by circulating air between two metal walls forming a jacket and is provided with a ported or permeable hearth extending along its entire length. The articles to be heated or baked in the furnace are supported therein on an air cushion formed with the heated air providing from the cooling jacket and supplied through the ported hearth.

10 Claims, 4 Drawing Figures

COOLED TUNNEL-FURNACE WITH GROUND EFFECT

This invention relates to a baking furnace with ground effect for ceramic tiles or other objects to be baked.

In the prior art such tiles have heretofore been baked in roller furnaces. The rollers, which are made of solid material, not only increase the amount of waste material but also have moving parts at high temperature. Baking time in such furnaces is long, which increases the cost of the backing operation. Furthermore, initial costs are rather high.

The prior art is also illustrated by the Shelley French Pat. No. 1,370,550 which describes a furnace having a perforated hearth and blown hot gas ascending therethrough to support, by ground effect (alternatively termed air cushion), the objects to be baked or else plates supporting the same, the said hot gas being recycled.

The present invention has for its objects firstly to considerably reduce the initial cost and operating cost of a furnace for baking ceramic tiles or any other object or product to be baked, dried or heated, including foods; secondly to provide a furnace having very low thermal inertia thereby to avoid the need for it to operate continuously and to consequently have night shifts, without this being detrimental to endurance or fuel consumption of the furnace; and thirdly to provide means for recycling high-temperature gases.

A furnace according to this invention is accordingly formed by an internal wall bounding a long tunnel-shaped chamber which is divided along its whole length by a perforated or porous hearth which bounds with said chamber a lower box and an upper corridor for baking the products. The furnace further includes means for supplying hot gas under pressure to the lower box, thereby to create through the hearth an ascending current for supporting the products above the hearth by ground effect, said furnace being characterized by an external wall surrounding the chamber or tunnel and connected to the lower box by an aerodynamic communication means such as a port or possibly a duct, whereby a cooling fluid such as air flowing through the space between the internal wall and the external wall helps to supply the hot gases which create the ground effect.

Thus a furnace according to the invention is a tunnel furnace cooled by air circulation through a double-wall jacket, thereby permitting metallic construction for both the tunnel and the jacket, with the indicated advantages of low cost and low thermal inertia. Further, the forced circulation of cooling air requires a certain amount of motive power, and in accordance with a second characteristic of the invention this motive power creates the pressure which generates the ground effect beneath the products to be baked.

Furthermore the temperature varies along the tunnel furnace as is customary, being maximum substantially halfway along it. The hot gases under pressure which lift the products slightly by a ground effect and at the same time heat them must not generally be discharged to the exterior. In order to make use of their heat they may be drawn into the upper baking corridor and recycled back into the lower box by recirculating means. In accordance with a third characteristic of the invention, these gases are mixed in said means with cooling air previously exchanged within the jacket.

Especially in the event that the gases are at very high temperature, the recirculating means are preferably formed by a static pump of the ejector type, the recirculating energy being thereby taken from the cooling air, in which case the latter receives high pressure from a fan positioned either upstream or downstream of the jacket (for even downstream of the jacket the air is only at relatively moderate temperature, at 120° C for example, whereas the gases may be at 1200° C).

If the recirculation process provided thus must take place in a very hot zone, then a burner may be inserted into the recirculation circuit and may be combined with said ejector, as described for example in French Pat. No. 2,157,066 filed by Bertin & Cie.

Further, a furnace according to this invention is preferably formed by successive sections that divide the tunnel lengthwise in accordance with a basic arrangement well-known per se, each section being adapted to create the required temperature.

In an embodiment of this kind utilizing customarily removable sections for permitting easy maintenance and rapid replacements, the recirculation according to any one of the methods described hereinabove may be made independently section by section, each hot zone having its own burner of appropriate heating capacity.

In accordance with a further characteristic of this invention, and without unduly complicating the section demounting operations, the recyclings are effected from a hot zone to a usually proximate but possibly contiguous cooler zone. This is because each recycling is accompanied by a cooling resulting firstly from the environment and secondly from the mixing with the double-wall cooling air, thereby making it possible to achieve in simple manner the required staggered temperatures along successive sections, starting from the hottest sections which alone require burners. The latter are consequently less numerous and more powerful, which facilitates their operation and reduces their cost.

By way of non-limitative example, a tile-baking furnace may have:

- a zone at an average of 100° C, formed by a modular section;
- a zone at an average of 400° C, formed by a modular section;
- a zone at an average of 700° C, formed by a modular section;
- a zone at an average of 1000° C, formed by a modular section;
- a zone at an average of 1200° C, formed by two modular sections;
- a zone at an average of 700° C, formed by four modular sections;
- a zone at an average of 400° C, formed by two modular sections;
- a zone at an average of 100° C, formed by three modular sections.

The thermal energy is communicated to the fluid under pressure by at least one burner, preferably a gas burner, or by any appliance for generating additional thermal energy.

By way of non-limitative example, each hearth perforation involves a pressure loss four times greater than the tile-supporting pressure in order to enable each tile to be supported independently without the need for the supporting fluid to follow a preferential path. Thus, part of the tiles can be withdrawn upon start-up or shutdown, or following operational incidents.

It is to be noted further that the cooling double-wall jacket may be extended even to form the hearth and may thus be made of metal.

The tiles issuing from the press or the drier are conveyed to the furnace entrance via a fluid track or by a roller-mounted conveyor belt and loaded into the furnace by a pusher or by the conveyor belt. The loading table may be of the dry-friction or fluid-track type. In accordance with a preferred characteristic that improves operation, the tiles are pushed onto the hearth, the slope of which is opposite to the direction of travel inside the furnace. Thus the tiles tend to push one another even though they are separated by a very thin gas leak, and remain aligned in orderly fashion. The tiles can then be channelled along a fluid track to an automatic storage or packing station, this being preferably facilitated by an accelerating process caused by a reversal of the hearth slope near the point of exit of the products.

The description which follows with reference to the accompanying non-limitative exemplary drawings will give a clear understanding of how the invention can be carried into practice.

Figure 1:
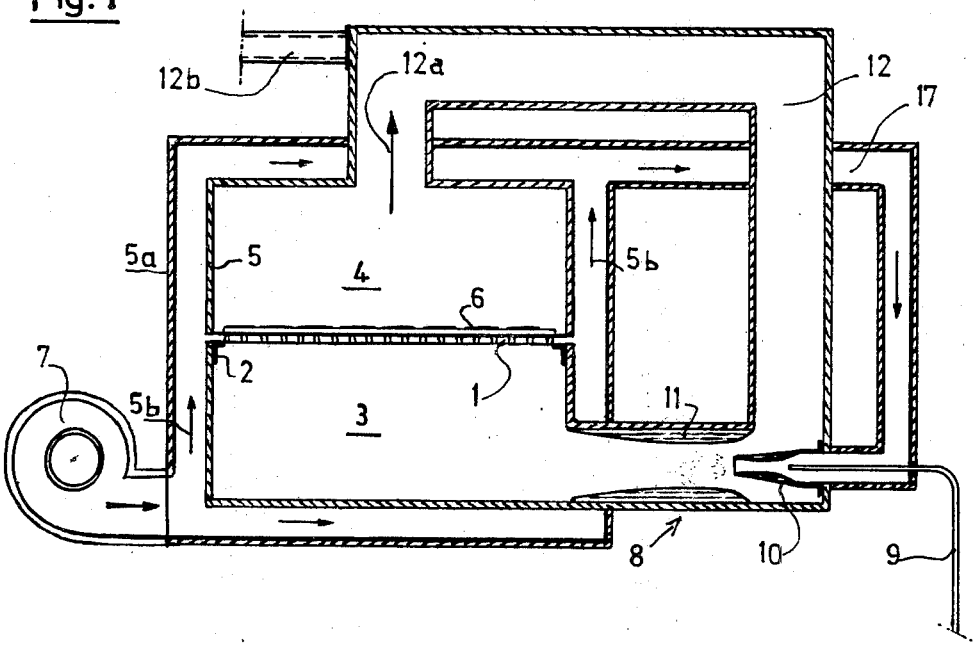
FIG. 1 shows diagrammatically in section and side elevation a modular-furnace section.
Figures 3, 4:
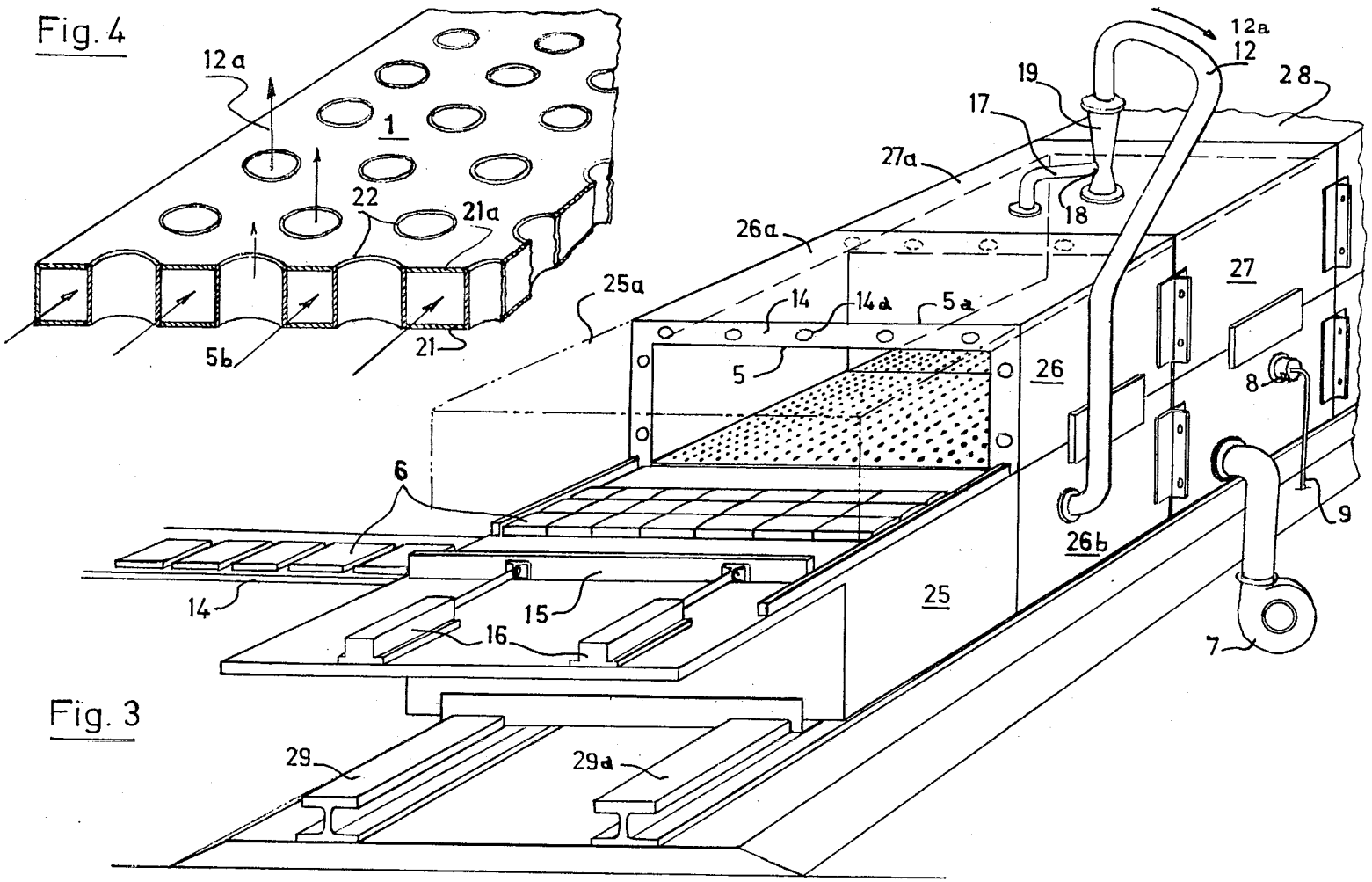

FIG. 3 diagrammatically depicts in partial section and in perspective sections of another alternative embodiment of the subject furnace of the invention, in which the tunnel fluid in the hot zones is recycled into the lower box of a cooler zone; and FIG. 4 schematically illustrates in perspective and at a larger scale a structural detail of FIG. 1, viz. a double-walled hearth.

Reference is first had to FIG. 1 for a showing of a modular section of the furnace according to the invention. The furnace is formed by the juxtaposition of such successive sections, which sections are preferably of metallic construction so that the furnace should have low thermal inertia. A porous or perforated hearth 1 carried on supports 2 divides the section into a lower box 3 and a corridor portion 4, the succession of boxes and the corridor extending over the entire length of the furnace. An internal wall 5 bounds the chamber comprising the corridor and the succession of boxes. An external wall **5*a* surrounds the chamber and has an aerodynamic communication 17 with the lower boxes. The section comprises only a portion of the walls 5 and 5*a*. The walls 5 and 5*a* are spaced by legs 27**.

The flow in the direction of arrows **5*b* is a forced circulation of a cooling fluid such as air. This fluid issues from a fan 7 which supplies the pneumatic energy. The latter serves to cool the furnace walls 5 and 5*a*, as well as the hearth 1 which in this case is double-walled, with transverse internal cooling of the kind shown on an enlarged scale in FIG. 4. The pneumatic energy is subsequently used further downstream to additionally create the current 12*a* ascending through the orifices 22 in hearth 1 (FIG. 4), which by a ground effect lifts the products to be baked 6, and said energy ultimately permits operation of burner 8**.

Fan 7 is in this case upstream of double-walled jacket 5, **5*a*, but alternatively may be positioned downstream thereof, for example immediately upstream of burner 8**.

Burner 8 is preferably a static member of the ejector type, as stated in the preamble, especially in the hottest furnace sections. In this case, for example, a combustible-gas inlet conduit 9 mixes the gas with the inducing cooling air discharged by fan 7 through a nozzle 10 which terminates communication means 17, and this ignited mixture induces the gases which by a ground effect have lifted the products 6 whilst heating them and which are collected inside corridor portion 4 via recirculation conduit 12, as shown by the arrow **12*a*. Such entrainment takes place within the shroud 11 of burner 8 and again heats the gases which are then reinjected beneath hearth 1. The surplus gas corresponding to the output of fan 7 is discharged via lower box 3 and corridor 4 to the furnace ends; part of this surplus may also be discharged through tube 12*b***, which may be connected to a chimney (not shown).

Figure 2:
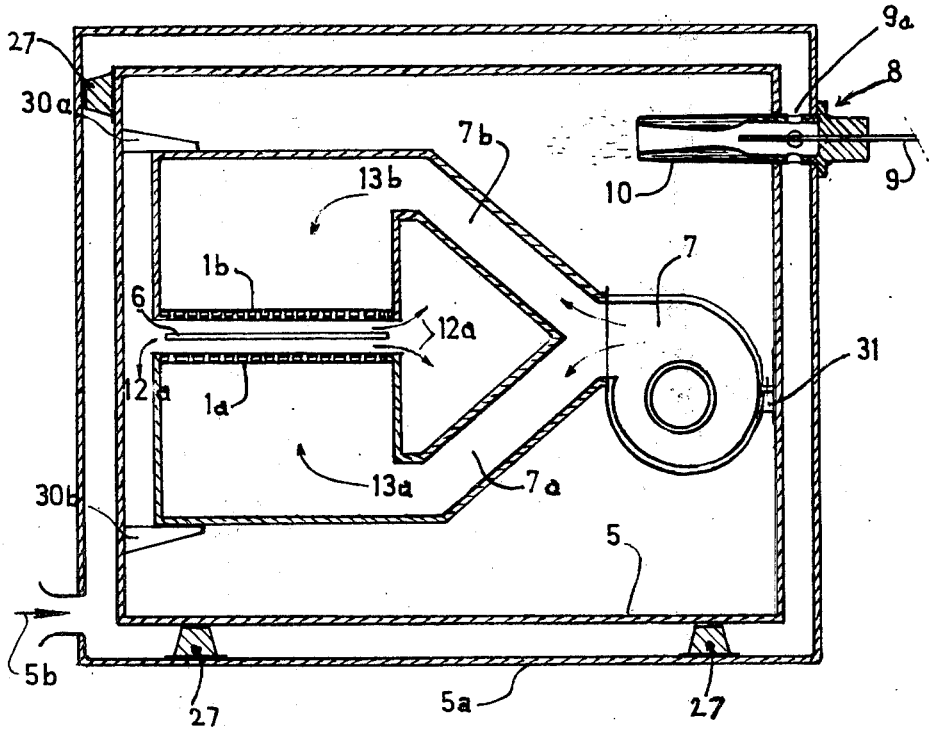
FIG. 2 shows an alternative embodiment.

In FIG. 2 like parts are designated by like numerals. The alternative embodiment shown here comprises a fan 7 which generates the ground effect through two hearths **1*a*, 1*b*, on opposite sides of the object 6 being processed and through the agency of conduits 7*a*, 7*b*, the gas circulating in the direction of arrows 13*a*, 13*b***.

The furnace according to this embodiment is adapted to moderate temperatures, for example 700° C, making it possible to position the fan 7/conduits **7*a*, 7*b* assembly together with the hearths 1*a*, 1*b* within the tunnel itself formed by internal wall 5, brackets 30*a*, 30*b* and 31** being provided to support the assembly.

In this embodiment the cooling air admitted along arrow **5*b* at the bottom of double walls 5, 5*a* is circulated as a result of induction through orifices 9*a* of the fuel injected at high pressure via conduit 9, the mixing and subsequent combustion taking place inside the venturi-shaped nozzle 10 of burner 8. The burnt gases are then picked up and recycled by fan 7**.

FIG. 3 portrays a furnace in which the recirculation along **12*a* is effected from the hottest sections towards the cooler sections. Objects 6 are charged into the furnace from a transverse conveyor 14 by a pusher 15 actuated by jacks 16**.

In respect of the furnace proper, there is shown a first inlet section 25, the corridor portion **25*a* delineated by dash lines having been removed for greater clarity. A second section 26 receives within its lower box 26*b*, via the oblique conduit 12, hot gas issuing from upper corridor portion 27*a* of third section 27. The furnace is extended by further sections, of which only one — section 28 — is partially shown. The various sections are aligned upon supporting beams 29, 29*a***.

In this particular embodiment, ejectors 19 are positioned at the tops of the hot furnace sections and receive directly the hot gases from the respective upper corridor portions 4 of the sections after the said gases have circulated with ground effect around the objects 6. These gases are repressurized in the ejectors 19 through being mixed with cooling air from double walls 5, **5*a* channelled through a tube 17 terminating at mixer 18 of ejector 19. This cooling air is in turn pressurized by fan 7 and driven into double walls 5, 5*a* of a hot section. It is communicated to the other sections through orifices 14*a* formed opposite one another in transverse plates 14** that bound the double-walled zones of the various individually demountable sections.

The burners 8 are fixed to the lower boxes of the hottest sections. They are supplied with fuel through conduits 9 and with air under pressure through communication means (not shown) with the gap between double walls 5, 5*a*, which gap is set under pressure by fan 7, as indicated precedingly.

FIG. 2 shows an example of a burner 8 so arranged, but in the alternative embodiment portrayed in FIG. 3 the combustion energy results primarily from the pressure in the double walls generated by fan 7.

FIG. 4 illustrates a hearth 1 which is bounded by walls 21, 21*a* with transverse cylindrical orifices 22. The space so bounded may be joined, as shown in FIG. 1, with the space bounded by double walls 5, 5*a* and crossed by the same cooling fluid along 5*b*. Thus in certain cases it is possible for such a hearth to be made of preferably refractory metal.

It goes without saying that changes and substitutions may be made in the exemplary forms of embodiment hereinbefore described without departing from the scope of the invention.

We claim:

1. A ground-effect type tunnel furnace of the kind including a cooling jacket through which fluid is circulated, and a permeable hearth device subdividing said tunnel furnace along its entire length on the one hand into a succession of pneumatic boxes and on the other hand into a work corridor for the accomodation of the articles to be processed adjacent said permeable hearth device, wherein the improvement comprises duct means connecting said cooling jacket to said pneumatic boxes, a burner in said duct means, and a fuel supply line leading to said burner, whereby said fluid after having circulated through said jacket and having been thereby heated is fed to said burner which in turn delivers burnt gases to said pneumatic boxes and thence across said permeable hearth device to levitate said articles by ground effect.

2. A furnace as claimed in claim 1, wherein said permeable hearth device comprises a double-walled ported sole having two spaced opposite sides bounding an intersticial space therebetween, and a plurality of passageways extending across but isolated from said intersticial space and opening out at said opposite sides to connect said pneumatic boxes with said work corridor.

3. A furnace as claimed in claim 2, wherein said intersticial space communicates with said cooling jacket to receive said fluid therefrom.

4. A furnace as claimed in claim 1, wherein said permeable hearth device comprises one ported sole, said pneumatic boxes occupy a lower position and extend beneath said ported sole, and said work corridor occupies an upper position and extends above said ported sole.

5. A furnace as claimed in claim 4, further comprising a feedback pipe interconnecting said upper work corridor and said lower pneumatic boxes, separate and distinct from said ported sole and in opposite flow direction with respect thereto.

6. A furnace as claimed in claim 5, wherein said burner is incorporated into a static ejector comprising (i) an energizing jet located at a confluence of said duct means and fuel supply line, and (ii) a fluid inducing shroud located in said feedback pipe and into which scid energizing jet opens.

7. A furnace as claimed in claim 6, further comprising a fan delivering pressure fluid to said cooling jacket and thence, via said duct means, to said energizing jet.

8. A furnace as claimed in claim 1, wherein said permeable hearth device comprises two ported soles opposite one another and bounding inwardly therebetween said work corridor, said pneumatic boxes extending outwardly of said two ported soles.

9. A furnace as claimed in claim 1, wherein said burner is incorporated into a venturi-shaped nozzle having a main body communicating with said jacket and a jet formed by the outlet of said fuel supply line.

10. A furnace as claimed in claim 9, further comprising a blower having an intake connected to the space into which said burner discharges, and a discharge connected to said pneumatic boxes.

* * * * *